US007377588B2

(12) United States Patent
Schreiber

(10) Patent No.: US 7,377,588 B2
(45) Date of Patent: May 27, 2008

(54) BACKREST WITH SPLINED MOUNT

(75) Inventor: Philip H. Schreiber, Denver, CO (US)

(73) Assignee: Sunrise Medical HHG Inc., Longmont, CO (US)

( * ) Notice: Subject to any disclaimer, the term of this patent is extended or adjusted under 35 U.S.C. 154(b) by 293 days.

(21) Appl. No.: 11/218,864

(22) Filed: Sep. 2, 2005

(65) Prior Publication Data

US 2006/0049680 A1 Mar. 9, 2006

Related U.S. Application Data

(60) Provisional application No. 60/608,389, filed on Sep. 9, 2004.

(51) Int. Cl.
*A47C 4/00* (2006.01)

(52) U.S. Cl. ..... 297/378.12; 297/378.1; 297/354.12

(58) Field of Classification Search ..... 297/354.1, 297/354.12, 378.1, 378.12, 378.14
See application file for complete search history.

(56) References Cited

U.S. PATENT DOCUMENTS

| | | | | | |
|---|---|---|---|---|---|
| 513,735 | A * | 1/1894 | Russell | 297/183.1 |
| 1,791,765 | A * | 2/1931 | Saunders et al. | 297/378.1 X |
| 2,042,886 | A * | 6/1936 | Ferguson | 297/378.1 X |
| 2,713,891 | A * | 7/1955 | Linquist | 297/378.12 |
| 2,792,876 | A * | 5/1957 | Emary | 297/364 |
| 3,918,822 | A * | 11/1975 | Rauschenberger | 297/354.12 X |
| 4,200,331 | A * | 4/1980 | Uchida | 297/354.12 X |
| 4,286,353 | A * | 9/1981 | Roche | 16/341 |
| 4,592,570 | A * | 6/1986 | Nassiri | 297/378.12 X |
| 4,659,146 | A * | 4/1987 | Janiaud | 297/354.12 X |
| 4,795,213 | A * | 1/1989 | Bell | 297/378.12 |
| 4,872,726 | A * | 10/1989 | White et al. | 297/354.12 X |
| 4,874,204 | A * | 10/1989 | Walk | 297/354.12 X |
| 4,881,776 | A * | 11/1989 | Wang | 297/378.1 |
| 4,938,603 | A * | 7/1990 | Turner et al. | 297/16.1 |
| 5,069,474 | A * | 12/1991 | Tai | 297/354.12 X |
| 5,069,503 | A * | 12/1991 | Martinez | 297/378.12 X |
| 5,152,543 | A * | 10/1992 | Sims et al. | 297/378.12 X |
| 5,240,265 | A * | 8/1993 | Huang | 297/354.12 X |
| 5,364,165 | A * | 11/1994 | Okamoto | 297/378.1 X |
| 5,380,113 | A * | 1/1995 | Boehm | 403/102 |
| 5,685,660 | A * | 11/1997 | Liao | 403/102 |
| 5,997,021 | A * | 12/1999 | Robinson et al. | 297/354.12 X |
| 6,135,476 | A * | 10/2000 | Dickie et al. | 280/250.1 |
| 6,322,148 | B1 * | 11/2001 | Kolena et al. | 297/354.12 X |
| 6,565,156 | B1 * | 5/2003 | Yamashita et al. | 297/354.12 |
| 6,789,848 | B2 * | 9/2004 | Rauschenberger et al. | 297/354.12 X |
| 6,857,703 | B2 * | 2/2005 | Bonk | 297/378.14 |
| 6,860,562 | B2 * | 3/2005 | Bonk | 297/378.12 |
| 6,910,739 | B2 * | 6/2005 | Grable et al. | 297/378.12 |
| 7,192,042 | B2 * | 3/2007 | Cerreto | 280/250.1 |
| 7,219,959 | B2 * | 5/2007 | Ransil et al. | 297/354.12 X |

* cited by examiner

*Primary Examiner*—Rodney B. White
(74) *Attorney, Agent, or Firm*—MacMillan, Sobanski & Todd, LLC

(57) ABSTRACT

A seating system comprises a mount for securing a backrest to a frame. The mount comprises two or more mating members. At least one of the mating members has a generally curved radial surface that is engageable with the other mating members to lock together the backrest with respect to frame.

19 Claims, 2 Drawing Sheets

BACKREST WITH SPLINED MOUNT

CROSS REFERENCE TO RELATED APPLICATIONS

This application claims the benefit of U.S. Provisional Patent Application No. 60/608,389, filed on Sep. 9, 2004.

BACKGROUND OF INVENTION

This invention relates in general to land vehicles and more particularly, to personal mobility vehicles. Most particularly, the invention relates to wheelchairs having adjustable backrests.

A wheelchair typically consists of a wheelchair frame that supports a seating structure, a backrest, and a plurality of wheels. A wheelchair backrest is commonly designed so that it can be positioned at various angles with respect to the seat platform. The seat platform is also typically adjustable to be positioned at various angles with respect to horizontal. This adjustment allows the wheelchair to accommodate individuals with specific seating and positioning needs, where the back angle and seat angle are critical for comfort, correct posture, performance, and other therapeutic requirements. Wheelchairs often incorporate folding backrests that allow the overall size of the wheelchair frame to be reduced in order to store or transport the unoccupied wheelchair. These wheelchairs typically have backrests that fold down against the seat platform to reduce the overall size of the frame.

Historically wheelchairs have employed the use of machined steel or aluminum plates to join the seat frame to the back frame. A latching mechanism is typically included such that the backrest can disengage and pivot to fold. The seat frame and back frame are usually constructed from steel or aluminum tubing. The plates are bolted to the sides of this tubing, and allow a limited range of angle adjustment between the seat and the backrest by providing a plurality of holes through which the backrest or seat can be bolted. One disadvantage of such a system is that the plates extend some distance along the seat tubes, occupying valuable real estate on the seat frame that is desirable for attaching other components, such as wheel mounting hardware. Another disadvantage is that the plates place undue stress on the backrest and seat tubes, and require that the tubing be thicker walled in order to withstand the stress. This results in a heavier wheelchair. These backrest systems often require that the wheelchair be unoccupied when adjustment is made to the back angle. This is inconvenient for the therapist and patient, where it is easier to properly fit a chair while the patient remains seated.

What is needed is a strong, lightweight means for attaching a wheelchair backrest that allows adjustability over a large range of backrest angles, provides a fine resolution of available angles, can be adjusted while the patient remains seated for correct fitting, and allows the backrest to be folded down for compact storage.

SUMMARY OF INVENTION

The present invention is directed towards a seating system that meets the foregoing needs. The seating system comprises a mount for securing a backrest to a frame. The mount comprises two or more mating members. At least one of the mating members has a generally curved radial surface that is engageable with the other mating members to lock together the backrest with respect to frame.

Various objects and advantages of this invention will become apparent to those skilled in the art from the following detailed description of the preferred embodiment, when read in light of the accompanying drawings.

DETAILED DESCRIPTION

Figure 2:
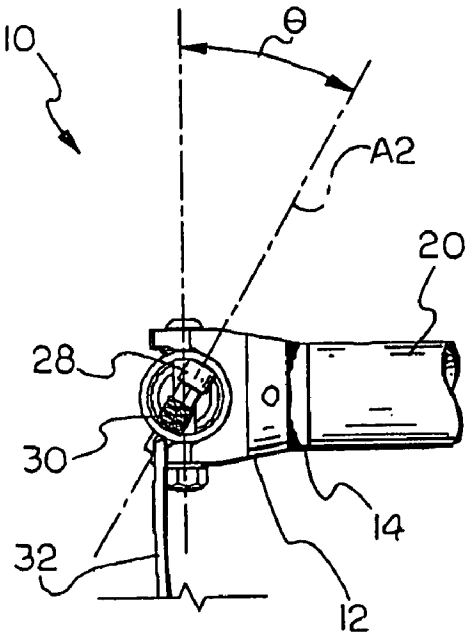
FIG. 2 is a bottom plan view of the backrest assembly shown in FIG. 1.
Figure 1:
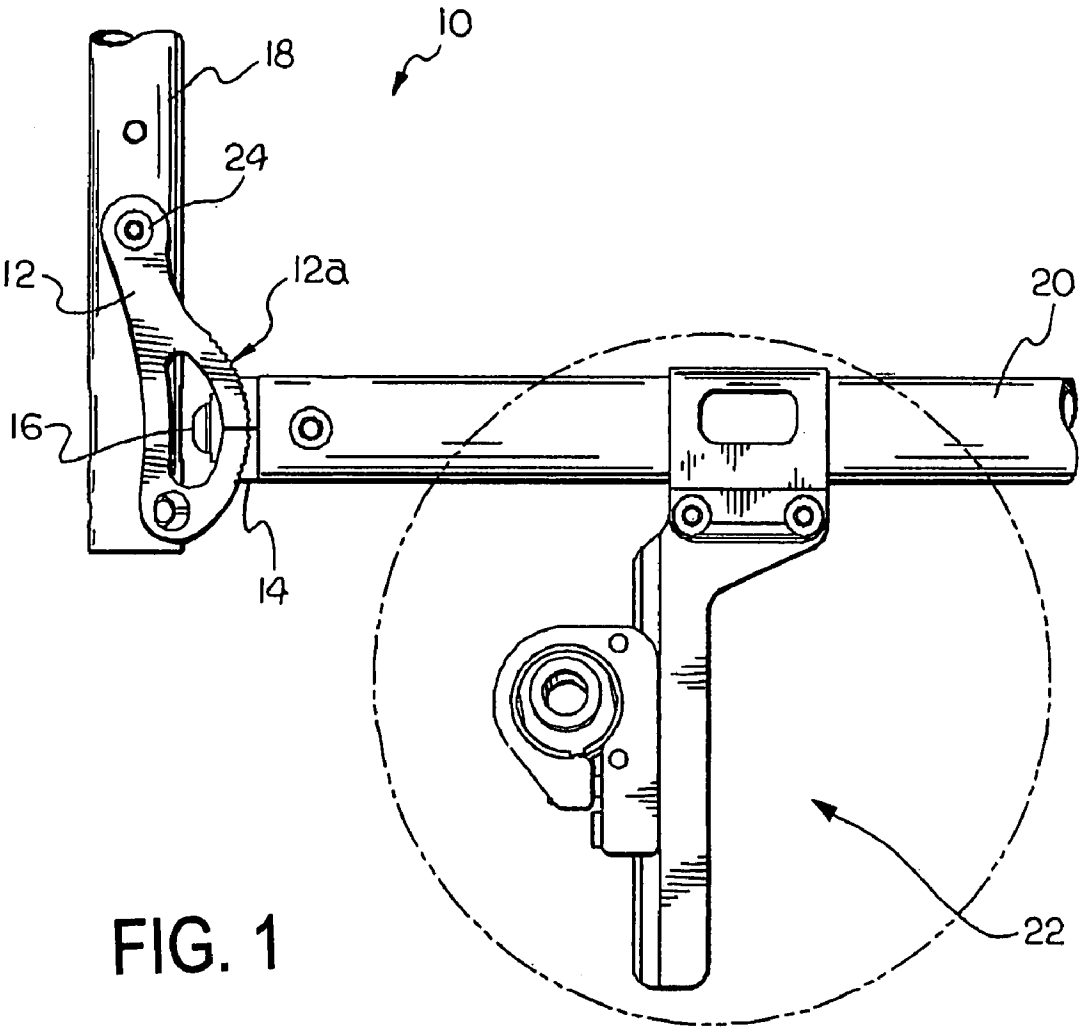
FIG. 1 is a side elevational view of a backrest assembly according to the invention.
Figure 3:
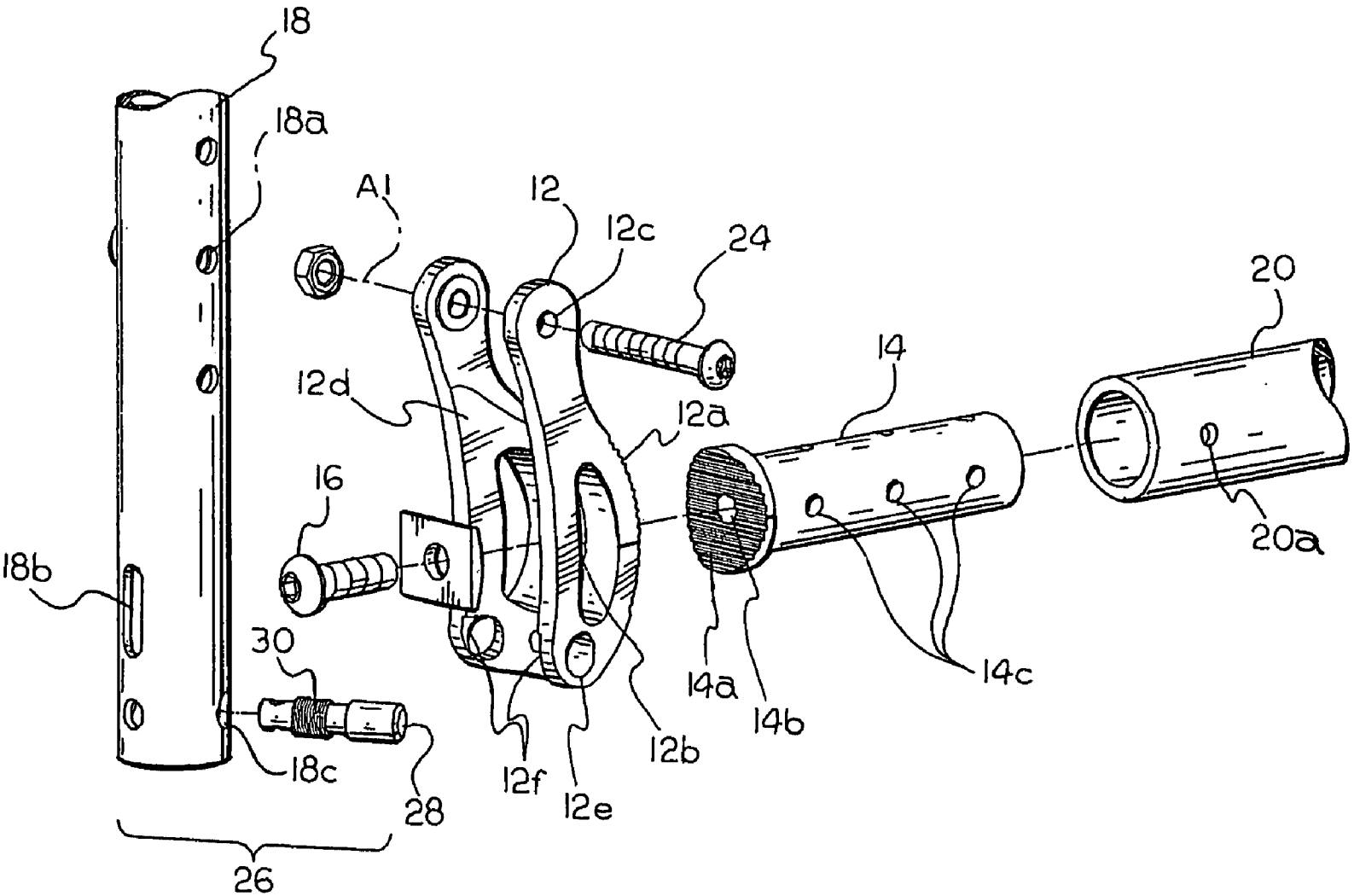
FIG. 3 is an exploded rear perspective view of the backrest assembly shown in FIG. 1.

Referring now to the drawings, there is illustrated in FIGS. 1-3 a backrest mount 10 for securing a backrest to a frame, such as a side frame or seat tube of a wheelchair. A single backrest is adapted to be supported by a pair of backrest mounts 10, one on the left side and the other on the right side of the backrest. The backrest mount 10 generally comprises a backrest bracket 12 and a mating seat plug 14 that are joined to one another by an adjustment bolt 16. The backrest bracket 12 is secured to a backrest tube 18. The seat plug 14 is secured to a side frame or seat tube 20. The backrest bracket 12 has a set of radial spline teeth 12*a* that form a generally convex surface of constant radius. The seat plug 14 has a complementary set of spline teeth 14*a* that form a generally concave surface of similar constant radius. These sets of spline teeth 12*a*, 14*a* mate with one another to secure the backrest to the seat frame at one of several fixed angular positions. The adjustment bolt 16 passes through slot 12*b* in the backrest bracket 12, and into a tapped hole 14*b* in the seat plug 14. When the adjustment bolt 16 is loosened, the angle of the backrest can be adjusted with respect to the seat. When the adjustment bolt 16 is tightened the backrest mount 10 is locked into a selected angular position via selective mating of the spline teeth 12*a*, 14*a*. The tooth spacing of the mating spline teeth 12*a*, 14*a* provides the increment of the backrest angular positions. The spline teeth 12*a*, 14*a* are preferably spaced at about 4° increments, and allow the included angle between the seat and back to be adjusted between about 66° and about 94°.

The seat plug 14 is secured within the inner diameter of the seat tube 20 by a bolt (not shown). In the preferred embodiment, the seat plug 14 telescopes fore/aft within the seat tube 20 so that the backrest is adjustable in depth, i.e. fore/aft with respect to the seat. The seat plug 14 has several tapped cross-holes 14*c* (shown in FIG. 3), one of which is selectively engaged with a cross-hole 20*a* (also shown in FIG. 3) in the seat tube 20 to establish the depth of the backrest. Because the seat plug 14 resides internal to the seat tube 20, the outer diameter of the seat tube 20 remains unobstructed, and is thereby available for mounting other chair components. In the preferred embodiment, this area along the seat tube 20 is used to clamp axle plates 22 that support the rear wheels (not shown). To provide adequate center-of-gravity adjustment, the axle plate 22 (shown in FIG. 1) needs to slide as far rearward on the seat tube 20 as possible. The backrest mount 10 of this invention makes such adjustment feasible.

The backrest tube 18 is secured to the backrest bracket 12 at axis A1 (shown in FIG. 3) so that the backrest tube 18 can pivot with respect to the backrest bracket 12 for folding. A pivot bolt 24 passes through the aligned holes 12*c*, 18*a* of the backrest bracket 12 and backrest tube 18, respectively, to create the folding pivot axis A1. A radius in the backrest bracket 12 forms a cradle 12*d* (shown in FIG. 3) that mates with and supports the backrest tube 18 when unfolded. This cradle 12*d* provides strength and rigidity to the backrest tube 18 as the occupant loads the backrest in the rearward and lateral directions. A pin-latch mechanism 26 secures the backrest tube 18 in the upright position and is manually or otherwise disengaged to allow the backrest to fold. The pin-latch mechanism 26 consists of a plunger pin 28 and compression spring 30 that are assembled within a hole 18*c* in the backrest tube 18, as shown in FIGS. 2 and 3. Spring force biases the plunger pin 28 to engage into a hole 12*e* in the backrest bracket 12. A retraction cord 32 is secured between plunger pins (only one shown) on the left and right-hand sides of the backrest. To fold the backrest the user applies a rearward force to the retraction cord 32, which simultaneously disengages both plunger pins and folds the backrest by rotating the backrest about pivot axis A1. This produces a user-friendly action whereby the occupant can fold the backrest with a one-handed operation in a single motion. Pin disengagement is facilitated by orienting the pin axis A2 at some angle theta θ. This angle aligns the pin 28 with the tensioned cord 32 such that the operation will simultaneously retract the left and right pins and fold the backrest. The backrest bracket 12 has a ramped surface 12*f* that causes the pin 28 to retract as the backrest is unfolded. This action allows the backrest to unfold and automatically lock into the unfolded position using a single motion. The slot 18*b* in the backrest tube 18 provides wrench access for loosening and tightening the adjustment bolt 16. This allows a therapist to make adjustment to the backrest angle while the user remains seated in the wheelchair. Components of the backrest assembly, including the backrest spline 12, seat spline 14, and pin latch mechanism 26 are designed symmetrically so that the same components can be used on both the left and right sides of the wheelchair. This saves on part cost and inventory.

In the preferred embodiment, mating splines are used to secure the backrest to the seat at one of several fixed angular positions. It is noted that other embodiments could incorporate different means of securing the backrest to the seat using generally mating convex and concave shapes that have interlocking or friction surfaces. These include, but are not limited to knurled surfaces, interlocking gear tooth profiles, high-friction materials, or the like. Such other embodiments are within the scope of this patent invention.

In the preferred embodiment, the splined component 12*a* attached to the backrest tube 18 has a generally convex constant radius profile, and the splined component 14*a* attached to the seat tube 20 has a generally concave constant radius profile. It is noted that in another embodiment the mating profile shape could be reversed. That is to say, the splined component attached to the backrest tube 18 could have a generally concave profile, and the component attached to the seat tube 20 could have a generally convex profile.

In the preferred embodiment, the means of attaching the backrest bracket 12 to the seat plug 14 is a bolt 16, of which the head is captured in a slot 12*b* within the backrest bracket 12 and having threads engaged in the seat plug 14. It is noted that other means of securing the backrest bracket 12 to the seat plug 14 could be employed within the scope of this patent, including the use of one or more bolts, nuts, screws, over-center clamps or other means of securing the backrest spline to the seat spline.

In the preferred embodiment, the backrest and seat frames are constructed from round tubing. The backrest bracket 12 and seat plug 14 components are bolted to this tubing. While the use of tubing is common in the wheelchair industry, it is noted that structures other than tubes could be used to create the backrest or the seat. However, it is the means of joining these two structures together to provide angle adjustment between the two structures that is covered by this patent. The spline features 12*a*, 14*a* could be formed, machined, or molded as an integral part of each respective back and/or seat structure, and these brackets could be mounted either interior, exterior, or abutted to the ends of the backrest and seat frame structures.

The wheelchair of the preferred embodiment is a manual (non-powered) wheelchair. It is noted that this invention has equal merit in applications involving power wheelchairs, or for that matter, any seating system requiring seat to back angle adjustment. The illustrations of the preferred embodiment display a non-folding wheelchair. However, this invention has equal merit in applications involving folding wheelchairs, where the means of folding is well known in the industry.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A seating system comprising a mount for securing a backrest to a frame, the mount comprising first and second mating members, at least one of the mating members having a generally curved radial surface that is engageable with the other mating member to lock together the mating members, the first mating member being secured in fixed relation to the frame, the backrest being mounted for pivotal movement in relation to the second mating member.

2. The seating system according to claim 1, wherein the mount further includes a lock for locking the backrest in an unfolded position.

3. The seating system according to claim 2, wherein the lock comprises a spring loaded member that functions to automatically lock the backrest in the unfolded position.

4. The seating system according to claim 3, wherein the spring loaded member is a plunger pin.

5. The seating system according to claim 3, wherein the plunger pin is oriented at an angle so that the plunger pin is generally along a direction of force to retract the plunger pin while folding the backrest.

6. The seating system according to claim 1, wherein the generally curved radial surface has radial splines.

7. The seating system according to claim 1, wherein the other mating member has a generally curved radial surface, the generally curved radial surfaces of the mating members having mating radial splines.

8. The seating system according to claim 1, wherein the generally curved radial surface is a radial friction surface that locks together the mating members.

9. The seating system according to claim 1, wherein the other mating member has a generally curved radial surface, the generally curved radial surfaces of the mating members being radial friction surfaces that lock together.

10. The seating system according to claim 1, wherein a plug is within one of the backrest or the frame, the plug being adapted to telescope within the backrest or the frame to allow the backrest to be adjusted in dept.

11. The seating system according to claim 1, wherein the generally curved radial surface is supported relative to a plug within at least one of the backrest or the frame.

12. The seating system according to claim 1, wherein one of the mating members has a cradle that supports a backrest tube.

13. A backrest mount for a personal mobility vehicle, the mount comprising:

a first member having a generally curved radial surfaces, a backrest supported for pivotal movement in relation to the first member;

a second member having a generally curved radial surface and being supported relative to a frame, the generally curved radial surfaces being matingly engageable with one another to lock the first member together with the second member.

14. The mount according to claim 13, wherein the first member is a bracket and the second member is a plug that is adapted to be supported within the frame.

15. The mount according to claim 13, wherein the generally curved radial surfaces are spine teeth surfaces.

16. The mount according to claim 13, wherein the generally curved radial surfaces are friction surfaces.

17. The mount according to claim 13, further comprising a latch mechanism comprising a plunger pin and a compression spring that are adapted to be assembled within the backrest, the spring being adapted to bias the plunger pin to engage a hole in the bracket.

18. The mount according to claim 17, further comprising a retraction cord secured to the plunger pin, wherein force applied to the retraction cord causes the plunger pin to disengage the bracket to allow the backrest to fold.

19. A wheelchair comprising:

a frame comprising at least one of a side frame or a seat tube;

a backrest tube; and a mount for securing the backrest tube to the frame, the mount comprising;

a first member secured in fixed relation to the frame, the first member having a first radial curved surface and a first interlocking feature fixed in relation to the first radial curved surface;

a second member adapted to be secured in relation to the first member, the second member having a second radial curved surface and a second interlocking feature fixed in relation to the second radial curved surface, the first and second interlocking features being engageable with one another in a plurality of angular positions, the backrest rube being mounted for pivotal movement in relation to the second member.

* * * * *

UNITED STATES PATENT AND TRADEMARK OFFICE

CERTIFICATE OF CORRECTION

PATENT NO. : 7,377,588 B2
APPLICATION NO. : 11/218864
DATED : May 27, 2008
INVENTOR(S) : Philip H. Schreiber It is certified that error appears in the above-identified patent and that said Letters Patent is hereby corrected as shown below:

In the Specification:

Column 6, Line 21, delete “rube”, insert --tube--

Signed and Sealed this

Nineteenth Day of August, 2008

JON W. DUDAS
*Director of the United States Patent and Trademark Office*